US005437505A

United States Patent [19]

Sanders et al.

[11] Patent Number: 5,437,505

[45] Date of Patent: Aug. 1, 1995

[54] SPRING-COMPENSATED BAIL RETAINING DEVICE

[75] Inventors: Brian C. Sanders, Salem; Peter F. Cram, Merrimack, both of N.H.

[73] Assignee: Ultrablend Systems, Inc., Londonderry, N.H.

[21] Appl. No.: 370,688

[22] Filed: Jan. 10, 1995

[51] Int. Cl.[6] ..... B01F 15/00

[52] U.S. Cl. ..... 366/209; 366/605; 220/737

[58] Field of Search ..... 366/348, 349, 605, 218, 366/208, 209, 210, 211, 213, 217, 219, 220, 216, 197; 220/737

[56] References Cited

U.S. PATENT DOCUMENTS

| | | | |
|---|---|---|---|
| 2,610,041 | 9/1952 | Stahl | 366/605 |
| 2,643,102 | 6/1953 | Bashford | 366/218 |
| 3,374,584 | 3/1968 | Haught | 366/208 |
| 4,235,553 | 11/1980 | Ball | 366/208 |
| 4,281,936 | 8/1981 | Schotter | 366/605 |
| 4,415,270 | 11/1983 | Heinis | 366/216 |
| 4,445,782 | 5/1984 | Sparrow | 366/217 |
| 4,693,440 | 9/1987 | Lalonde | 220/737 |

*Primary Examiner*—Robert W. Jenkins

*Attorney, Agent, or Firm*—Devine, Millimet & Branch

[57] ABSTRACT

In a paint mixing apparatus, a paint can carrying bail retaining device, said device comprising a retaining ring that is movably attached to a blending bucket, said bucket having a diameter selected such that a paint can easily be inserted therein for the mixing or blending operation. The retaining ring has a radius slightly larger than the radius of the mixing bucket plus the thickness of the paint can carrying bail. The retaining ring has a loading/unloading and a retaining position. When the ring is displaced from its retaining position, which is corresponds to its normal position, into its loading/unloading position, sufficient clearance is created to allow the bail to swing freely into a mixing position, where it rests along the outside of the mixing bucket. When the ring is returned to its retaining position, the bail is secured in the mixing position as a result of a lack of sufficient clearance to allow the bail to swing away from its position along the outside of the mixing bucket.

3 Claims, 1 Drawing Sheet

SPRING-COMPENSATED BAIL RETAINING DEVICE

FIELD OF THE INVENTION

The present invention relates to a novel apparatus for securely holding the lifting handles, or bails, of all popular varieties of paint containers during the blending process or mixing motion of rotational paint mixing machines.

BACKGROUND OF THE INVENTION

Mixing of various materials, for example paint, has been the subject of numerous inventions. Early devices consisted of mechanical agitating machines capable of shaking a paint can or the like in order to mix the contents therein. These early devices required substantial mechanical structures and were often anchored to the floor since vibration was a major consideration. In order to improve upon these early devices, a subsequent generation of devices evolved that utilizes rotational motion about multiple axes to thoroughly mix the contents of a container with little or no vibration. U.S. Pat. Nos. 4,235,553 and 4,497,581 disclose two such rotational mixers. These types of rotational mixers are the preferred devices used today. Additionally, since these machines do not impart a vibrational or shaking motion to a can of paint, these devices do not require the operator to securely clamp the container of paint to be mixed into position.

While these devices are much quieter in operation than agititation devices, are more portable, are easier to use and are generally preferred, since no clamping of the paint can is required, these devices contain no means for securely holding the carrying handle, or bail in such a way as to prevent the unnecessary damage to the bail. Thus, a paint can carrying bail is capable to freely swinging during the mixing or blending operation of the machine, which could result in the carrying bail being deformed during the mixing or blending operation. Thus, it would be difficult to remove the paint can from the machine after the mixing or blending operation. Furthermore, if the carrying bail were to become dislodged during the mixing or blending operation, the carrying bail could become entangled in the motion generating mechanism of the machine and thereby cause severe damage the machine.

U.S. Pat. No. 4,445,782, which issued to Sparrow on May 1, 1984, discloses a paint can carrying bail retaining device used in a shaking-type paint mixing apparatus. While the device disclosed in the Sparrow reference accomplishes the same purpose as the invention of the Applicant claimed herein, there are fundamental distinctions between the devices. First, and perhaps foremost, in the Sparrow device, if a paint can is inserted into the paint shaking apparatus, the pain can carrying bail must be held in position by the operator with one hand while the operator displaces the bail retaining mechanism with his or her other hand. Thus, the securing of the paint can carrying bail in the Sparrow apparatus is a two-handed operation. Conversely, as will be more fully explained in below, the novel configuration of the Applicant's spring-compensated bail retaining device allows for the securing of a paint can carrying bail with a single hand.

The present invention overcomes the problem associated with prior art paint mixing machines by providing a device capable of securely holding a paint can carrying bail in a fixed position during the paint mixing or blending operation of a rotational paint mixing machine. The bail retaining device disclosed herein consists of a simple ring that is movably attached, and preferably pivotally attached, to a paint can blending bucket of a typical rotational material mixing machine and is sized specifically to allow a paint can carrying bail to be secured in position with a minimum amount of motion. This allows paint can carrying bails to be securely retained in position during the mixing or blending process and yet it also allows for simple and rapid insertion and removal of the paint can.

OBJECTS OF THE INVENTION

Accordingly, it is a object of the present invention to provide a paint container carrying bail retaining device to prevent the damage of carrying bails during the mixing or blending motion imparted by rotational paint mixing devices.

Another object of the present invention is to provide a paint container carrying bail retaining device that can be adapted for use in existing rotational mixing machines.

A further object of the present invention is to provide a paint container carrying bail retaining device that is compatible with carrying bails provided with paint cans made of different materials and of slightly different designs.

Still another object of the present invention is to provide a paint container carrying bail retaining device that is easy to operate to both secure and free a paint can carrying bail during the process of loading and unloading the paint can from a paint mixing machine.

Yet another object of the present invention is to provide a paint container carrying bail retaining device that is capable of being manipulated by an operator of a paint mixing machine in such a manner that the step of securing the carrying bail is a one-handed operation.

These and further objects of the invention will become apparent from the following description.

SUMMARY OF THE INVENTION

The foregoing objectives are achieved in a paint mixing device having a paint can carrying bail retaining device, said device comprising a retaining ring that is movably attached to a blending bucket, said bucket having a diameter selected such that a paint can easily be inserted therein for the mixing or blending operation. The retaining ring has a radius slightly larger than the radius of the mixing bucket plus the thickness of the paint can carrying bail. The retaining ring has a loading-/unloading and a retaining position. When the ring is displaced from its retaining position, which is also its normal position, into its loading/unloading position, sufficient clearance is created to allow the bail to swing into a mixing position, where it rests along the outside of the mixing bucket. When the ring is returned to its retaining position, the bail is secured in the mixing position as a result of a lack of sufficient clearance to allow the bail to swing away from its position along the outside of the mixing bucket.

DETAILED DESCRIPTION OF THE DRAWINGS

Figure 1:
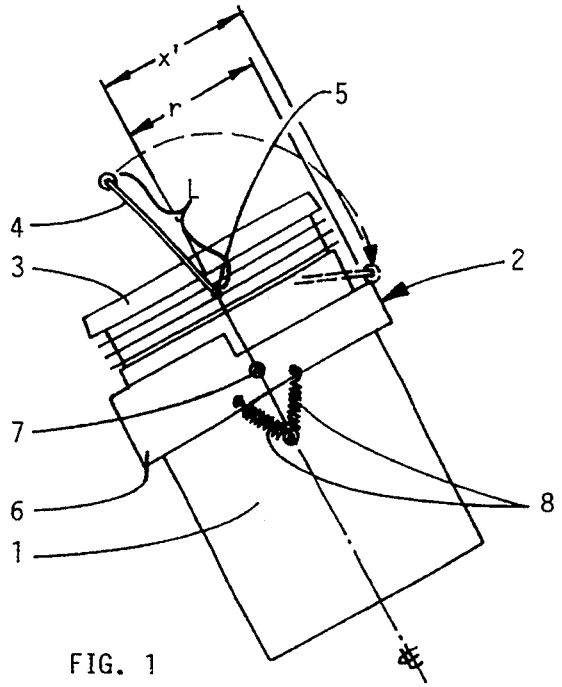
FIG. 1 is a side view of the mixing bucket and carrying bail retaining device showing a typical five gallon can of paint inserted in the bucket and the paint can carrying bail resting upon the retaining ring while it is in its neutral, retaining position.

Referring now to the drawings, FIG. 1 shows the combination of a typical rotational paint mixing machine blending bucket 1 and the disclosed paint can carrying bail retaining device, generally indicated as 2, in its neutral, retaining position. Inserted into the blending bucket 1 is a typical five gallon can of paint 3, which has a typical carrying handle or bail 4.

To load paint can 3 into a typical rotational paint mixing machine, can 3 is lowered into bucket 1 by an operator who holds carrying bail 4. While the can is being lowered into the bucket, the carrying bail is generally in a position substantially aligned along the longitudinal axis of the paint can, since the person carrying the can must impart a force equal and opposite to the gravitational force exerted upon the can lest the can be pulled to the earth. Once the paint can 3 is aligned with the blending bucket 1, it is slowly lowered into the bucket 1 by the operator. Once seated into the bucket 1, the can 3 is completely supported by the bucket 1 such that there is no longer any weight being carried by the carrying bail 4.

When the weight is released from the carrying bail 4, the operator simply allows the bail 4 to swing about its attachment point to the paint can 5 such that it rests upon the upper surface of the retaining device 2. The retaining device 2 is made up of a retaining ring 6, which is movably attached to the outside of the blending bucket 1. Although the means by which the ring 6 may be movably attached to the bucket 1 may vary, the inventors have found that the preferred method of movably attaching the same is by pivotally attaching the ring at pivot points 7, which are at opposite intersections of a diameter of the ring with its circumference. The ring is attached at pivot points 7 through the use of pins, rivets, screws or the like to the outside of blending bucket 1.

Figure 2:
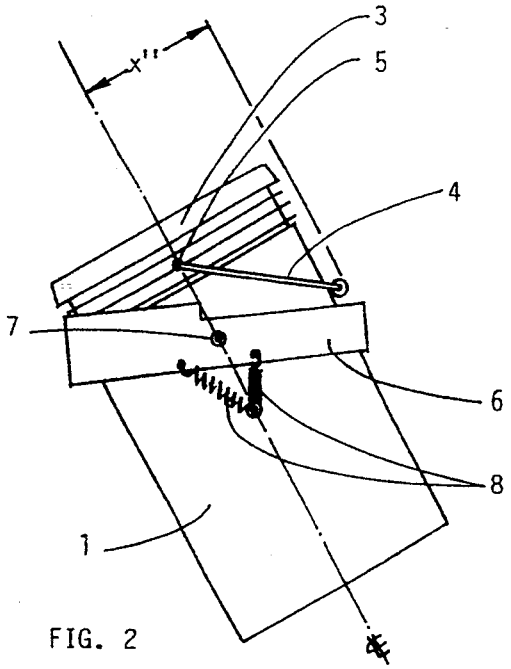
FIG. 2 is a side view of the mixing bucket and carrying bail retaining device showing a typical five gallon can of paint inserted in the bucket and the retaining ring displaced into its loading/unloading position thus allowing the carrying bail to resting along the outside of the mixing bucket.
Figure 3:
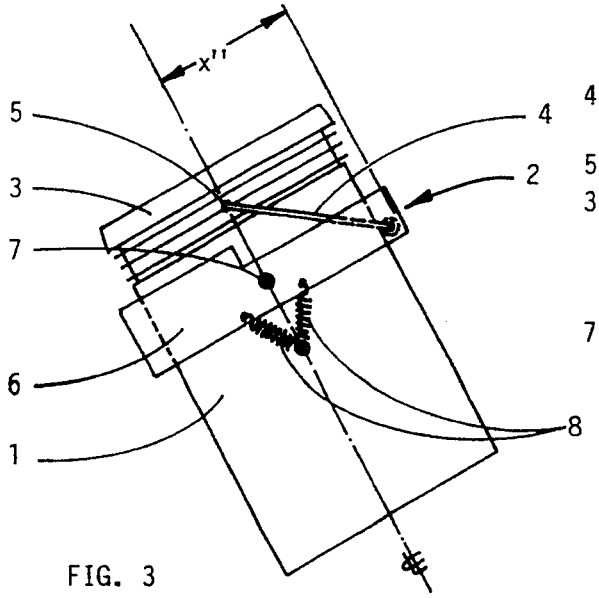
FIG. 3 is a side view of the mixing bucket and carrying bail retaining device showing a typical five gallon can of paint inserted in the bucket and the retaining ring returned to its neutral, retaining position after the carrying bail has been allowed to swing into its mixing position, which is at rest along the outside of the mixing bucket.

The retaining ring 6 has generally two positions—a neutral, retaining position as shown in FIGS. 1 and 3 and a loading/unloading position as shown in FIG. 2. The ring is generally maintained in is neutral, retaining position, which is substantially perpendicular to the longitudinal axis of the paint can 3, by the use of a plurality of springs, collectively represented as 8. The springs 8 are generally employed in pairs adjacent to each pivot point 7. A first end of each spring is attached to an attachment point 9 on the outside of the blending bucket 1 at a point along the longitudinal axis of the bucket. A second end of each spring 8 is attached to the retaining ring at a point 10 along the ring which is somewhat displaced from the pivot point 7. Attachment points 10 of each spring in a pair are substantially equally spaced from pivot point 7 in a direction perpendicular to the longitudinal axis of the bucket 1 when the ring is in its neutral, retaining position.

The inventive concept disclosed herein is accomplished by selecting a ring of an optimal size and movably attaching said retaining ring to the bucket 1 as described immediately above. By choosing a retaining ring 6 with a radius that is only slightly greater than the radius of the blending bucket plus the thickness of the carrying bail, the carrying bail retaining device becomes extremely effective. In this manner, there is sufficient clearance between the outside of the blending bucket 1 and the retaining ring 6 so that the carrying bail 4 may rest against the outside of the blending bucket when the paint can 3 is inserted into the bucket 1 during the blending operation. Yet, the radius of the retaining ring 6 is not too great to allow the carrying bail to swing away from its retained position during the blending operation.

Figure 4:
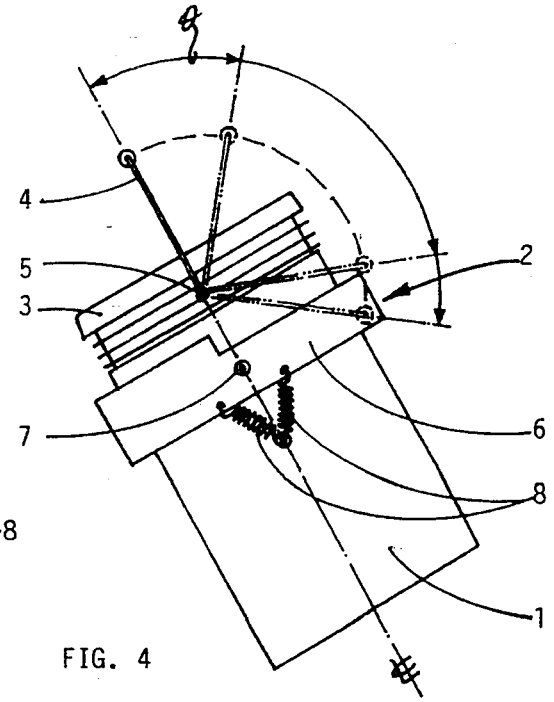
FIG. 4 is a side view showing the geometry of the carrying bail in its various positions and the resultant longitudinal and radial components of its length dimension.

This is simply a matter of geometry. The carrying bail 4 has a length L. When the bail 4 is aligned with the longitudinal axis of the paint can 3, as shown in FIG. 4, the bail projects only in the longitudinal direction a distance equal to length L and has no projection in a radial direction. Similarly, when the bail is in a position exactly perpendicular to the longitudinal axis of the paint can 3, the bail projects only in the radial direction a distance equal to its length L and has no projection in the longitudinal direction. Any time that the bail is in a position other than either precisely aligned with, or precisely perpendicular to, the longitudinal axis of the paint can, there will be a projection in both the radial direction and in the longitudinal direction, generally designated as x and y respectively. The laws of geometry indicate that the dimension y will be equal to the length of the bail L multiplied by the cosine of the angle $\theta$, where $\theta$ is the angular displacement of the carrying bail from a position aligned with the longitudinal axis of the paint can 3. Similarly, the x dimension will be equal to the length of the bail L multiplied by the sine of the angle $\theta$, where $\theta$ again the angular displacement of the carrying bail from a position directly aligned with the longitudinal axis of the paint can 3.

As can be seen from FIG. 1, when the paint can 3 is inserted into blending bucket 1 by an operator, carrying bail 4 is allowed to rest upon the upper surface of retaining ring 6, which is in its neutral, retaining position. In this position, the ring 6 is substantially perpendicular to the longitudinal axis of the paint can 3. Since, in this position, the radial projection x' of the carrying bail 4, is slightly greater than the radius r of the retainer ring 6, the carrying bail is blocked by retainer ring 6, and thus prevented from resting along side of the blending bucket 1. In such a position, the carrying bail 4 would be capable of freely swinging during the operation of the rotational paint mixing device, thus subjecting the carrying bail to the risk of being bent, or even dislodged from the paint can. As can be appreciated, a deformed handle would impede the removal or a paint can from the machine and a dislodged handle could become entangled in the rotational paint mixing machine's motion generating mechanism, thus severely damaging the machine.

Returning now to FIGS. 1–3, once the paint can 3 is inserted into blending bucket 1 and the carrying bail 4 is rested upon retaining ring 6, the operator will then displace the retainer ring 6 from its neutral, retaining position into its loading/unloading position, as shown in FIG. 2. In this position, retaining ring 6 is pivotally displaced a sufficient amount to provide ample clearance to allow the carrying bail 4 to swing into its mixing position, which is at rest along the outside of the blending bucket 1, as shown in FIGS. 2 and 3.

As can be seen in FIG. 2, when the retaining ring is displaced into its loading/unloading position, one spring in each pair of springs 8 associated with each retaining ring pivot point 7 is placed under tension, while the second spring in the pair is unloaded. When the retaining ring 6 is released by the operator, springs 8 operate to return the retaining ring 6 to its neutral, retaining position, as shown in FIG. 3. Since the radius r of retaining ring 6 is also selected to be slightly greater than the radial projection x″ of the carrying bail 4 when the bail is at rest along the outside of the blending bucket 1, there is sufficient clearance for the retaining ring to pass thereover, thus, encompassing the carrying bail 4 along the outside of the blending bucket. Since the radius r of the retaining ring 6 is also selected to be slightly less than the radial projection x′ of the carrying bail 4, when carrying bail 4 is at a position resting on top of the retaining ring 6, as shown in FIG. 1, retaining ring 6 also blocks the carrying bail 4 from swinging away from its mixing position along the outside of blending bucket 1, in much the same way in which retaining ring 6 prevents the carrying bail 4 from falling into its mixing position when the paint can 3 is first inserted into blending bucket 1.

Furthermore, as shown in FIGS. 1–3, the retaining ring 6 may have varying heights to allow compatibility of the carrying bail retaining device 2 with paint cans manufactured of different materials, such as plastic or metal, and of slightly different carrying bail 4 and carrying bail connection geometries.

Accordingly, the appended claims should be construed broadly and in a manner consistent with the spirit and scope of the invention disclosed herein.

We therefore claim:

1. In a material mixing device having a mixing bucket of a diameter sized to hold a standard size can of paint or the like, said can having a carrying bail, said bail having a length and a thickness, a spring-compensated, carrying bail retaining device comprising a retaining ring movably attached to said bucket, said ring having a loading/unloading position and a neutral, retaining position, said ring further having a radius that is slightly greater than the radius of said mixing bucket plus the thickness of said carrying bail, wherein, when said ring is displaced from its neutral retaining position into its loading/unloading position, sufficient clearance is created to allow said bail to swing into a mixing position where it is at rest against said mixing bucket and, when said ring is returned to its neutral, retaining position, said bail is secured in said mixing position as a result of a lack of sufficient clearance to allow said bail to swing away from its mixing position where it is at rest against said mixing bucket.

2. In a material mixing device, the spring-compensated, carrying bail retaining device claimed in claim 1, wherein said retaining ring is pivotally attached to said blending bucket at two pivot points, said pivot points at opposite ends of a diameter of said ring, thus allowing said ring to be rotationally pivoted about said pivot points to provide sufficient clearance to allow said carrying bail to swing into, and out of, said mixing position where is at rest against said mixing bucket.

3. In a material mixing device, the spring-compensated, carrying bail retaining device claimed in claim 2, wherein said retaining ring is further attached to said blending bucket using springs that operate against each other to hold said ring in a neutral, retaining position, when no external force is applied to said ring, said springs allowing said ring to be pivotally displaced from said neutral, retaining position into said load/unload position, at least one of said springs placed under load when said ring is in other than its neutral, position, which, in turn will impart a force upon said ring to return said ring to its neutral position.

* * * * *